US005680166A

United States Patent [19]

Nishiberi

[11] Patent Number: 5,680,166

[45] Date of Patent: Oct. 21, 1997

[54] RECORDING APPARATUS HAVING PAPER EJECTION TRAY

[75] Inventor: Nozomu Nishiberi, Kawasakishi, Japan

[73] Assignee: Canon Kabushiki Kaisha, Tokyo, Japan

[21] Appl. No.: 354,444

[22] Filed: Dec. 12, 1994

Related U.S. Application Data

[63] Continuation of Ser. No. 950,996, Sep. 25, 1992, abandoned.

[30] Foreign Application Priority Data

Oct. 2, 1991 [JP] Japan ..... 3-282285

[51] Int. Cl.[6] ..... B41J 13/10

[52] U.S. Cl. ..... 347/108; 347/104

[58] Field of Search ..... 347/104, 108, 347/139, 153, 164, 218, 262; 361/681, 686; D18/44, 55, 56

[56] References Cited

U.S. PATENT DOCUMENTS

| | | | |
|---|---|---|---|
| 3,154,356 | 10/1964 | Lewis et al. | 271/207 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,995,602 | 2/1991 | Nakadai et al. | 271/207 |
| 5,238,235 | 8/1993 | Nitta et al. | 271/9 |
| 5,240,243 | 8/1993 | Gompertz et al. | 271/209 |
| 5,253,139 | 10/1993 | Satou | 361/681 |
| 5,329,422 | 7/1994 | Sasaki | 361/686 |

FOREIGN PATENT DOCUMENTS

| | | | |
|---|---|---|---|
| 59-123670 | 7/1984 | Japan . | |
| 299962 | 12/1988 | Japan | 347/108 |
| 0008174 | 1/1989 | Japan | 271/207 |

*Primary Examiner*—N. Le

*Attorney, Agent, or Firm*—Fitzpatrick, Cella, Harper & Scinto

[57] ABSTRACT

A recording apparatus includes a recording head such as an ink jet recording head, a sheet feeder for feeding recording medium sheets to a recording section where recording is performed by the recording head, and a sheet ejection tray for receiving the recording medium sheets ejected from the recording head after recording by the recording head, The apparatus has an outer housing, a portion of which provides a structure for detachably supporting the sheet ejection tray at one end of the tray, and a portion which defines a space for detachabldy storing the sheet ejection tray when the recording apparatus is not used.

8 Claims, 9 Drawing Sheets

RECORDING APPARATUS HAVING PAPER EJECTION TRAY

This application is a continuation of application Ser. No. 07/950,996 filed Sep. 25, 1992 abandoned.

BACKGROUND OF THE INVENTION

1. Field of the Invention

The present invention relates to a recording apparatus having recording means for recording information on a recording member and, more particularly, to a recording apparatus of the type which has a paper ejection tray.

2. Related Background Art

Nowadays, various recording apparatuses are used, such as printers, copying machines and facsimiles, as well as recording apparatuses which are used as output devices such as computers, word processors and work stations. These recording apparatuses are designed to record various images on various types of recording members or media such as sheets of paper, thin plastic sheets for OHPs and so forth, in accordance with image information. These recording apparatuses, typically printers, can be categorized according to the recording principle, such as, for example, ink jet printers, wire dot printers, thermographic printers, thermal transfer printers and laser beam printers, Recording apparatuses also can be categorized according to the manner of operation. In one type of recording apparatus known as a serial recording apparatus or printer, recording is conducted in a main scan direction, which is transverse to the direction of sub-scanning in which a recording member is fed. More specifically, a carriage carrying a recording means, e.g., a recording head, moves along the recording member set on a predetermined portion of the apparatus so that main scanning is performed by the recording head to form an image along one line of recording on the recording member. After each main scan, the recording member is fed so that a sub-scan is performed, followed by the next main scan. An image is formed on the entire area of the recording member as the above-described operation is repeated. In another type of recording apparatus known as a line printer, recording of an image can be performed solely by sub-scanning effected by the feed of a recording member. More specifically, this type of recording apparatus employs an array or arrays of a plurality of recording elements which selectively and simultaneously operate to form a pixel image along one line of recording. After recording of the one-line pixel image, the paper is fed by a predetermined pitch, followed by the recording of the next one-line pixel image. This operation is conducted repeatedly until a desired image is formed on the recording member. Among various known types of recording apparatuses, the ink jet recording apparatus performs recording by jetting an ink onto a recording member from a recording head and offers various advantages. More specifically, the ink jet type recording head can have a compact construction as compared with other types of recording heads, and is capable of performing recording of delicate images at high speeds, even on plain papers without requiring any specific treatment of the paper. Furthermore, this type of recording apparatus can operate at a low running cost, and the noise level is low due to non-impact nature of the recording head. In addition, multicolor printing can easily be conducted by using a plurality of inks having different colors.

Various types of ink jet recording heads are available, among which a recording head of a type which jets inks by using thermal energy is prominent in that it can easily be produced by forming, on a substrate, layers or films serving as electrothermal transducers, electrodes, liquid channel walls and top walls, by utilizing semiconductor production techniques such as etching, evaporation and sputtering. The ink jet recording head produced by such a process can have a compact construction with a multiplicity of ink channels and openings arranged at a very high density.

Small-sized portable personal computers such as notebook-type computers are finding spreading use, and various small-sized and light weight recording apparatuses such as printers have been developed for use in combination with such small-sized computers. Most such small-sized recording apparatuses employ foldable paper ejection trap which can be folded to reduce the overall size of the recording apparatus when the latter is not used. When the recording apparatus is used, the paper ejection tray is developed to facilitate ejection of the recording member after the recording and to stack and hold the recording members in a neat manner.

Known recording apparatuses employing paper ejection trays suffer from the following disadvantages. Namely, the paper ejection tray, which is designed to meet the demands for both small installation area in the folded state and superior paper performance for smoothly and efficiently receiving ejected recording members, is complicated in construction and difficult to handle. Consequently, the cost of the apparatus is raised, and users are often confused as to how to use the paper ejection tray.

SUMMARY OF THE INVENTION

Accordingly, an object of the present invention is to provide a recording apparatus equipped with a paper ejection tray which is inexpensive and which is easy to use.

To this end, according to the present invention, there is provided a recording apparatus, comprising: recording means; feeding means for feeding recording medium sheets to said recording means; a sheet ejection tray for receiving recording medium sheets ejected from said recording means after recording by said recording means; sheet ejection tray supporting means provided in a portion of an outer wall of said recording apparatus and detachably supporting said sheet ejection tray at one end of said tray; and sheet ejection tray storage means provided in a portion of said outer wall of said recording apparatus for detachably storing said sheet ejection tray when said recording apparatus is not used.

In specific forms of the invention, the sheet ejection tray storage means is provided in the bottom of the apparatus or under the mechanism which feeds the recording medium sheet during recording. The sheet ejection tray may be provided with an auxiliary supporting means which includes a member hinged at its one end to the underside of the tabular portion of the tray.

According to the invention, the sheet ejection tray has an inexpensive and simple construction which is easy to handle, by virtue of the sheet ejection tray supporting means which detachably supports one end of the sheet ejection tray and the sheet ejection tray storage means for detachably storing the sheet ejection tray when the recording apparatus is not used.

The advantage of the present invention is further enhanced when the sheet ejection tray storage means is provided in the bottom of the recording apparatus or under the mechanism which feeds the recording sheet during recording, or when an auxiliary supporting means including a member hinged to the tray is employed.

DESCRIPTION OF THE PREFERRED EMBODIMENTS

The preferred embodiments of the present invention will be described with reference to the accompanying drawings.

Figure 3A:
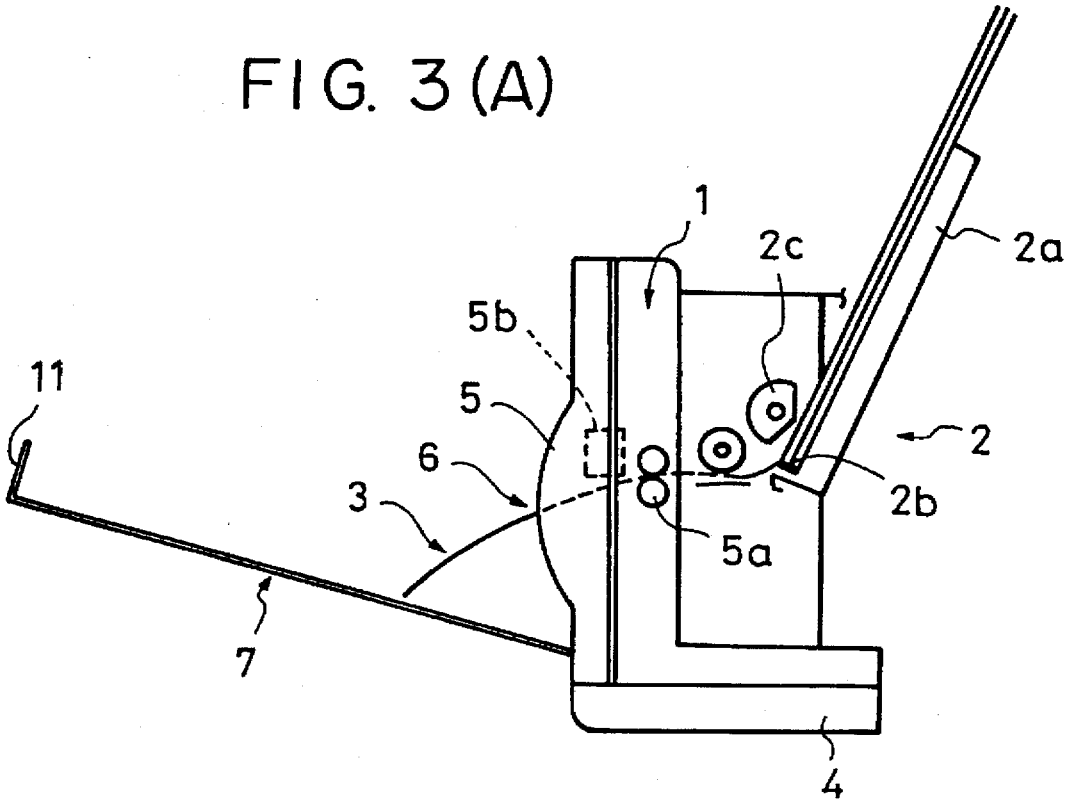
FIGS. 3(A) and 3(B) are fragmentary side elevational views of the recording apparatus shown in FIG. 1 in a state in which a print paper as a recording member is being ejected onto a paper ejection tray.

Referring to FIG., a first embodiment of the recording apparatus in accordance with the present invention has an outer housing 1, an automatic sheet feeding unit 2, a bottom cover 4 which forms the bottom of the outer housing 1, and a recording unit 5 which performs recording on a recording member such as a sheet of paper. Referring to FIG. 3(A), the automatic sheet feeder 2 has a feeder tray 2*a*, a separation claw 2*b* and a feeding roller 2*c*. In operation, recording members such as paper sheets are stacked on the feeder tray 2*a* and the sheets are separated and fed one by one into the recording unit 5 by the operation of the separation claw 2*b* and the feeding roller 2*c*. The recording unit 5 includes a feed roller 5*a* for feeding the recording member 3, a recording means (recording head) for forming an image including letters and symbols on the recording member 3, and a carriage 56 for reciprocally moving the recording means along the recording member so as to perform main scan. In the illustrated embodiment, the recording unit 5 is of the ink jet type which records an image by jetting an ink or inks onto the recording member.

Referring again to FIG. 1, numeral 6 denotes a paper ejection portion (paper exit) through which a recording member 3 which has passed the recording unit 5 is ejected, and numeral 7 denotes a paper ejection tray for holding ejected recording members 3. The paper ejection tray 7 may be a molded tabular member made of, for example, an ABS resin.

The ink jet type recording head used in this embodiment jets an ink or inks by using thermal energy produced by the electrothermal transducer. The thermal energy applied by the electrothermal transducer causes film boiling of the ink so as to generate a bubble of the ink. Growth and contraction of the bubble causes a change in the pressure of the ink which produces a force for discharging an ink droplet from the discharge opening, thereby recording an image.

Figure 2:
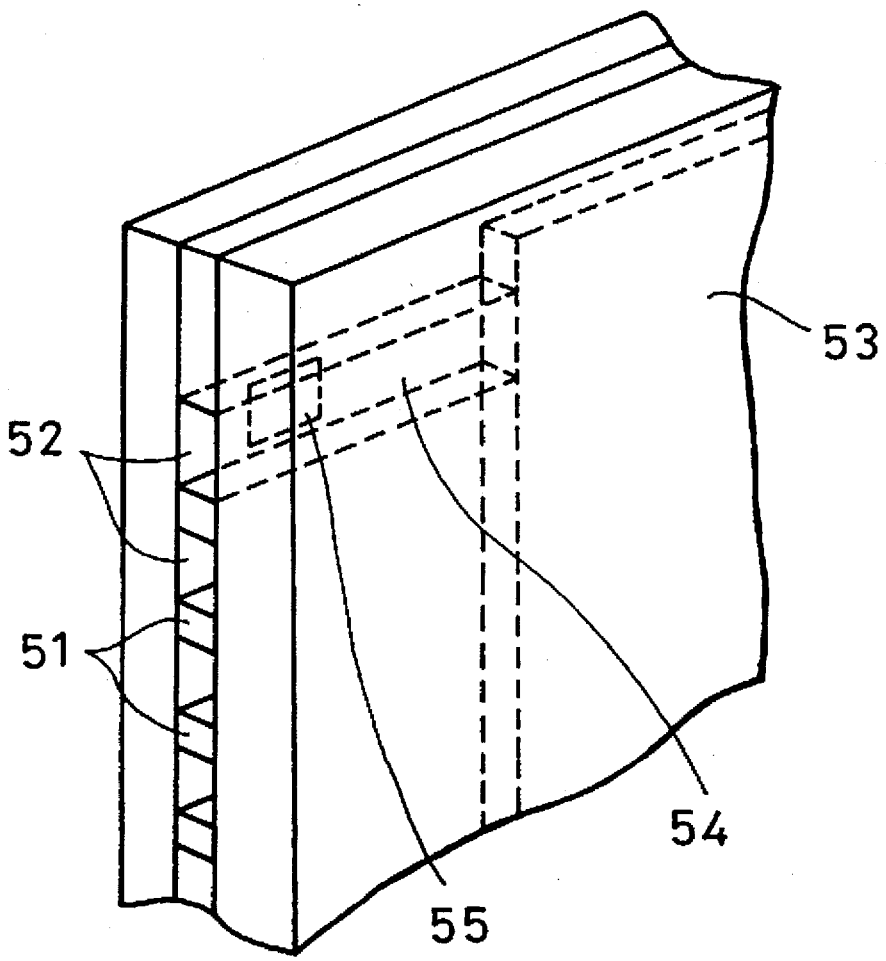
FIG. 2 is a schematic fragmentary perspective view of an ink jetting portion of a recording means incorporated in the recording apparatus shown in FIG. 1.

FIG. 2 is a fragmentary perspective view showing the detail of the ink discharging portion of the recording head. The recording head has a discharge opening surface 51 which faces the recording member 3 leaving a minute gap, e.g., about 0.5 to 2.0 mm, therebetween. A multiplicity of ink discharge openings 52 are formed in this surface 51 at a predetermined pitch and communicate with a common ink chamber 53 through respective ink channels 54. The electrothermal transducer 55 such as an exothermal resistor for generating the ink jetting thermal energy is arranged along a wall of each ink channel 54. In the illustrated embodiment, the discharge openings 52 are arranged in a direction which crosses the direction of the main scan, the direction of movement of the carriage. In operation, the electrothermal transducers 55 are selectively energized in accordance with image signals or discharge signals so as to cause film boiling in the associated ink channels 54 so that the ink is selectively jetted from the ink jet openings 52 connected to these ink channels, thus performing the recording of an image.

The operation of this recording apparatus is as follows. A suitable number of sheets as the recording members 3 are placed on the feeder tray 2*a* of the automatic sheet feeder 2. As the recording apparatus starts to operate in response to a recording command from an external device such as a computer, the feeding roller 2*c* in the automatic sheet feeder 2 is driven to feed the recording members 3 one by one into the recording unit 5, When the leading end of the recording member 3 reaches the feed roller 5*a* of the recording unit 5, the feed roller 5 rotates to transfer the recording member 3 to a predetermined record start position.

Then, the carriage 5*b* carrying the recording head is activated to move in the main scan direction along the recording member 3, and the recording head is driven in accordance with the image signals in timed relation with the main scan movement of the carriage 5*b*, whereby one-line pixel image is formed on the recording member 3. After completion of printing of one-line pixel image, the recording member 3 is advanced or fed by a predetermined amount in the direction of the sub-scanning and, thereafter, the carriage is started again to move the recording head in the direction of the main scanning and the recording head is driven in accordance with the image signal in synchronization with the movement of the carriage, thereby recording the next one-line pixel image. Thus, the movement of the carriage, i.e., main scanning, and the feeding of the recording member 3, i.e., sub-scanning, are performed alternately and repeatedly so as to form the desired image two-dimensionally on the recording member 3.

The leading end of the recording member 3 reaches the paper ejection tray 7 past the exit 6, while pixel images are being formed thereon, and after completion of the recording the recording member 3 is finally ejected to rest on the paper ejection tray 7. The end 11 of the paper ejection tray 7 opposite to the recording apparatus is bent upward in an L-like form so as to provide a stopper for preventing the ejected recording member 3 from slipping down over the end of the tray 7. The stopper also serves to enable the ejected recording members to be stacked on the tray 7 in registration at their leading ends.

Figure 3B:
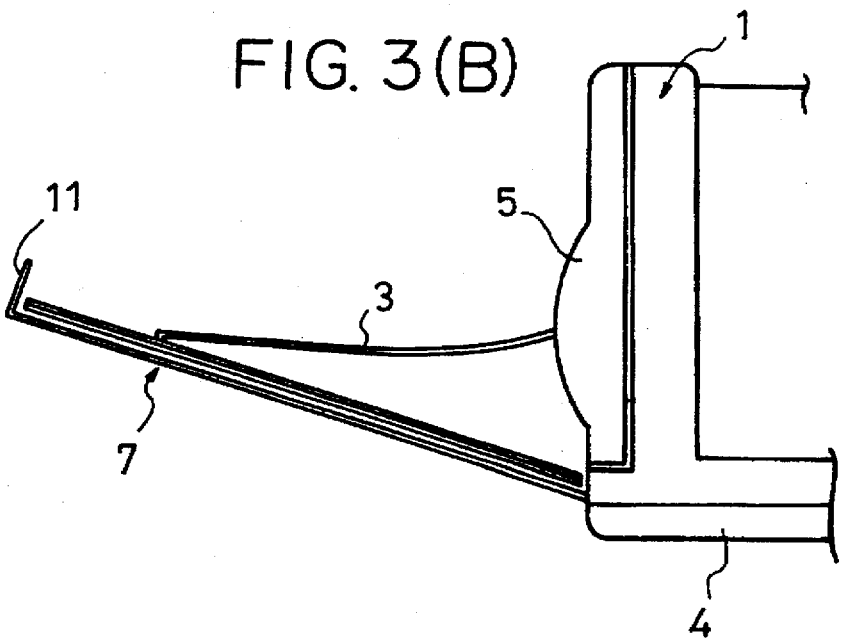

FIGS. 3(A) and 3(B) schematically show the manner in which the recording members 3 are ejected onto the paper ejection tray 7. More specifically, in FIG. 3(A), the leading end of the first recording member 3 has just contacted the surface of the paper ejection tray 7, whereas, in FIG. 3(B), a plurality of ejected sheets have been stacked on the tray 7. The paper ejection tray 7 is detachable from the body of the recording apparatus so that the area occupied by the apparatus is reduced when the recording apparatus is not used.

Figure 4:
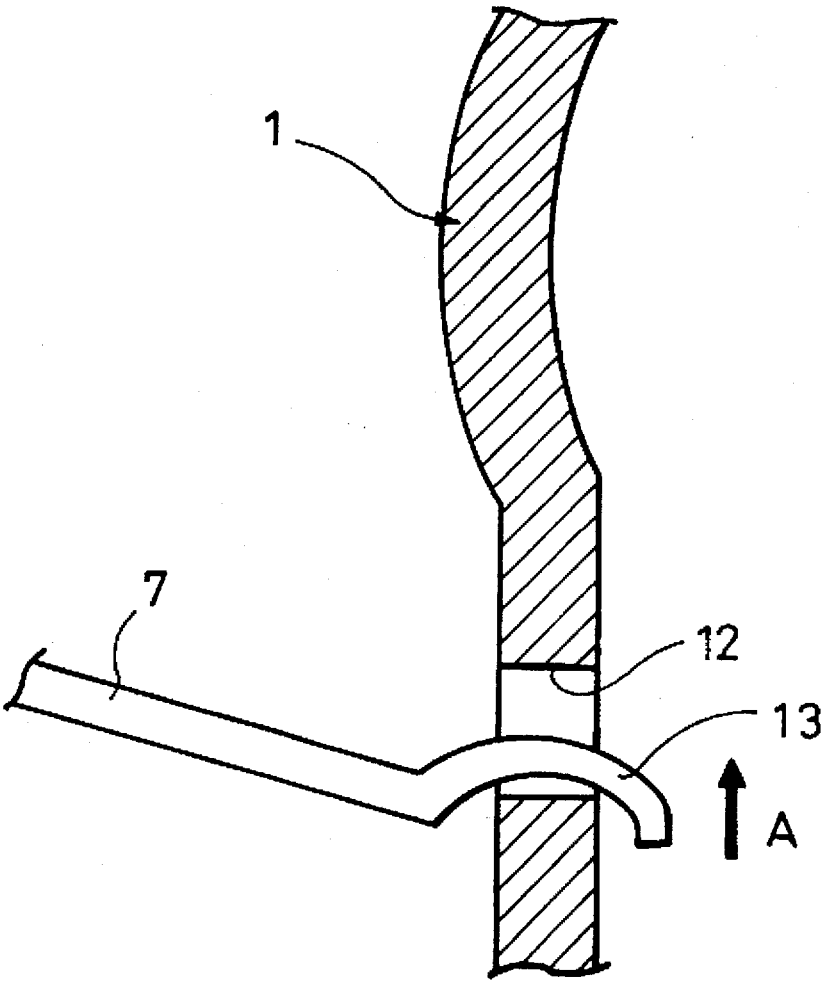
FIG. 4 is a fragmentary longitudinal sectional view of the recording apparatus shown in FIG. 1, specifically illustrating the construction of a paper ejection tray supporting means.
Figure 5:
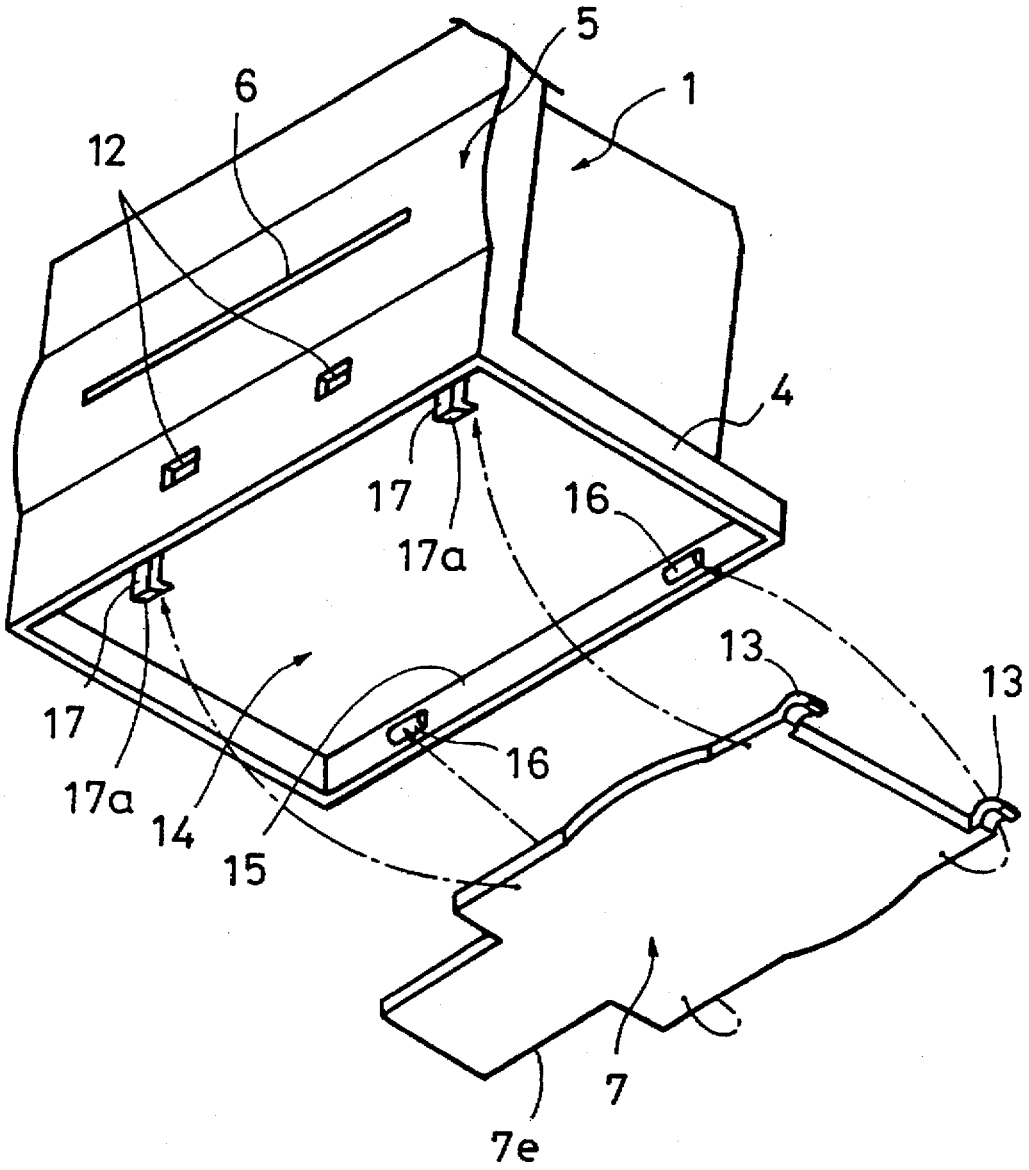
FIG. 5 is a schematic perspective view of a paper ejection tray storage means.
Figure 8:
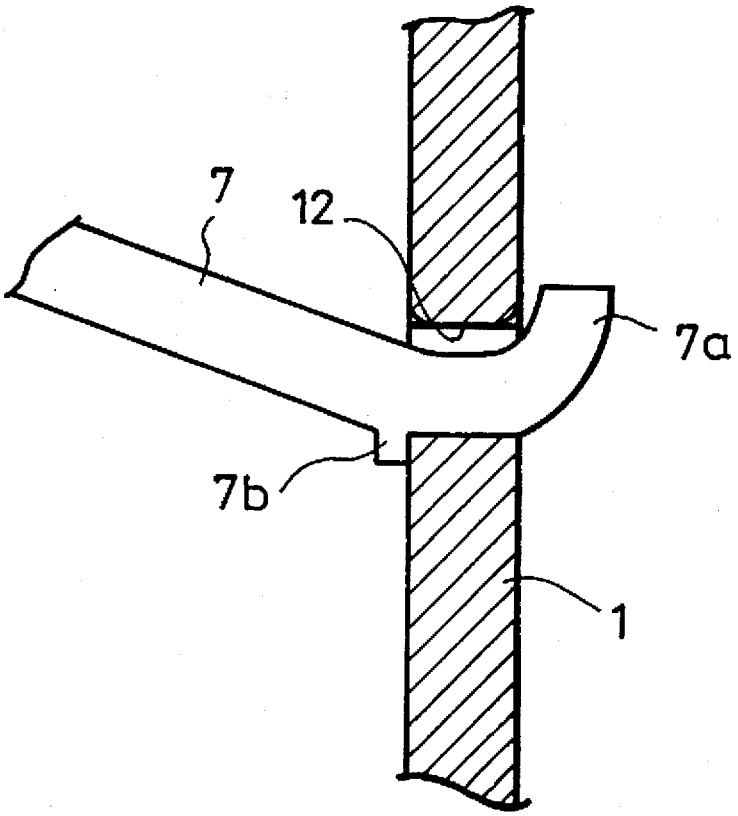
FIG. 8 is a longitudinal sectional view illustrating a practical example of the tray supporting means shown in FIG. 4 together with a tray.

FIG. 4 schematically shows an example of the structure for detachably securing the base end of the paper ejection tray 7 to the outer housing 1. Referring also to FIG. 5, a pair of retaining holes 12 are formed in the wall of the outer housing 1 having the recording member exit 6. The paper ejection tray 7 has a pair of upwardly convex tabs 13 which are formed on both lateral ends of the base end of the paper ejection tray 7 and which are adapted to be inserted into and to engage the retaining holes 12 formed in the wall of the outer housing 1 so that the paper ejection tray 7 is detachably secured to the outer housing 1. The paper ejection tray 7 can easily be separated from the body of the recording apparatus simply by being lifted in the direction of arrow A and then pulled. FIG. 8 shows the detail of another example of the structure for supporting the paper ejection tray 7 on the body of the recording apparatus. Numeral 7*a* denotes an upwardly curved tab retained in the retaining hole 12 formed in the wall of the outer housing 1. The paper ejection tray 7 also has a projection 7*b* projecting downward from the lower surface of the tray 7. The projection 7*b* abuts the outer surface of the wall of the outer housing 1 when the tab 7*a* is retained in the retaining hole 12, so as to prevent the tray 7 from rotating counterclockwise as viewed in FIG. 8. It will be seen that the paper ejection tray 7 can be separated from the wall of the outer housing 1 simply by being swung clockwise as viewed in FIG. 8.

FIG. 5 is a perspective view of the recording apparatus as viewed from the bottom side, illustrating the construction of a paper ejection tray storage means 14, More specifically, a recess 15 having a depth greater than the thickness of the paper ejection tray 7 is formed in the underside of the bottom cover 4 of the outer housing 1, Projections 16, and snapping projections 17, for engaging with both lateral ends of the paper ejection tray 7, are provided on opposing inner surfaces of the walls defining the recess 15. The paper ejection tray 7 can be stored in the recess 15 with its opposing sides retained by the projections 16, and the hook projections 17, The end portion of the paper ejection tray 7 opposite to the tabs 13 is notched as at 7*e* so that the user, when extracting the paper ejection tray 7 from the recess 15, can insert a finger into the space between the bottom surface of the recess 15 and the paper ejection tray 7 so as to deflect the paper ejection tray 7, to disengage it from the projections 16 and then from the snapping projections 17. The user, when storing the paper ejection tray 7 in the recess, simply places the tray 7 in the recess such that the tray 7 is retained at its one lateral side edge by the projections 16, and then pushes the other lateral side of the tray 7 so that the other lateral side edge slips along tapered surfaces of the snapping projections 17 while resiliently deflecting these snapping projections 17 so as to achieve a snapfit on the step surface of the snapping projections 17, whereby the paper ejection tray 7 can be stored in the recess 15.

Figure 6:
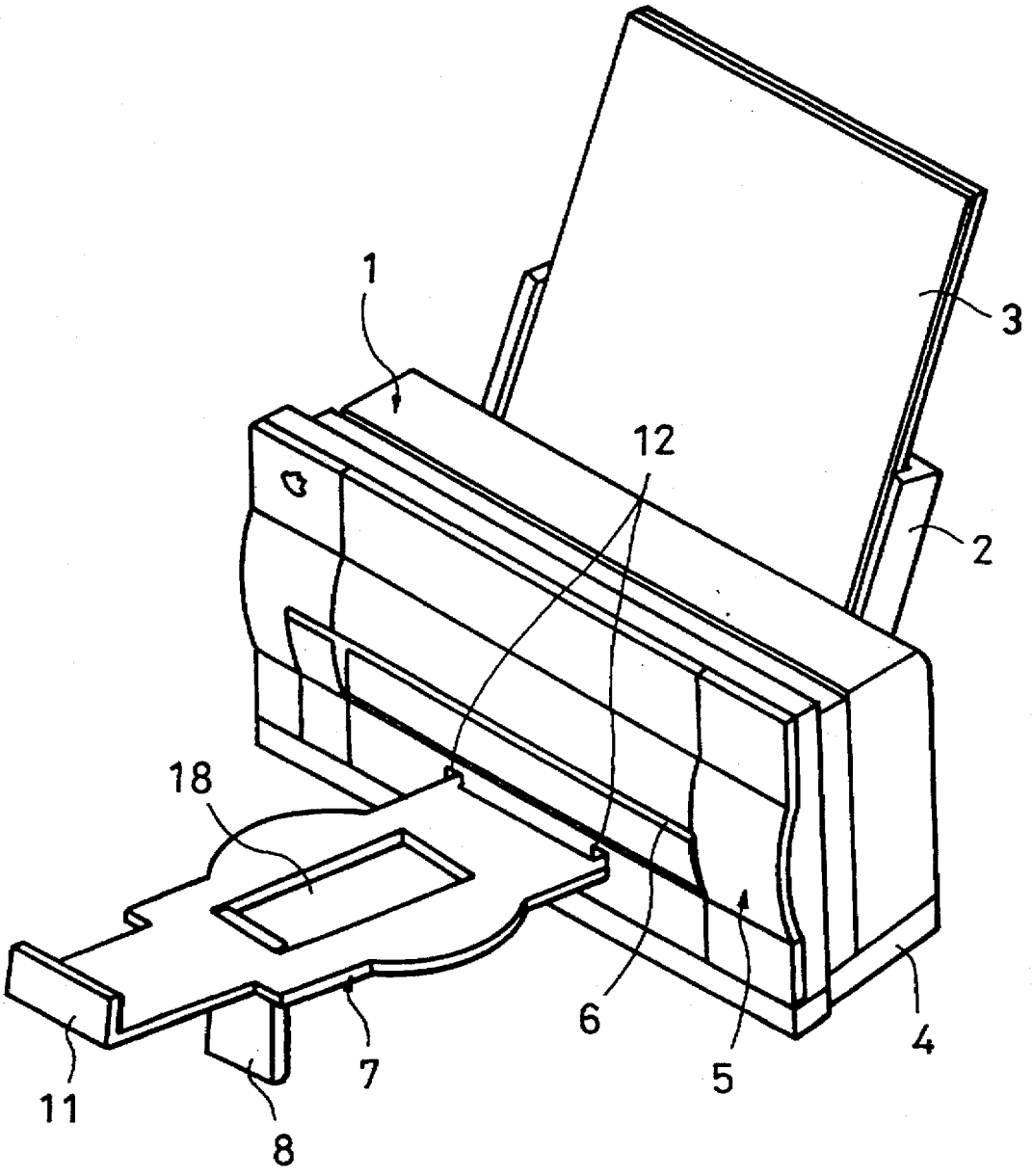
FIG. 6 is a schematic perspective view of a second embodiment of the recording apparatus in accordance with the present invention.

FIG. 6 is a schematic perspective view of a second embodiment of the recording apparatus of the invention having a paper ejection tray. The paper ejection tray 7 has, in addition to the supporting structure similar to that of the first embodiment, a paper ejection tray supporting member 8 serving as a second supporting means. The paper ejection tray supporting member 8 is a tabular member which is hinged at its one end to the paper ejection tray 7.

When the recording apparatus of FIG. 6 is used, a pair of tabs 13 (see FIG. 5) formed on the base end of the paper ejection tray 7 are inserted into and retained by retaining holes 12 formed in the wall of the outer housing 1 as described before, and the paper ejection tray supporting member 8 is swung to a plane perpendicular to the plane of the tray 7 so as to stand up against the surface of a desk or the like mounting the recording apparatus. Attaching and detaching of the paper ejection tray 7 to and from the body of the recording apparatus can be conducted easily in the manner described before. When the recording apparatus is not used, the paper ejection tray supporting member 8 is folded to lay substantially in the same plane as the paper ejection tray 7, and the paper ejection tray 7 is stored in the storage means 14 provided in the reverse side of the bottom cover 4. The paper ejection tray 7 in the embodiment shown in FIG. 6 has an aperture or window 18 which receives the folded supporting member 8 serving as the second supporting means. This, however, is not exclusive and the arrangement may be such that the supporting member 8 is folded down into a recess formed in the reverse side of the paper ejection tray 7.

Figure 7:
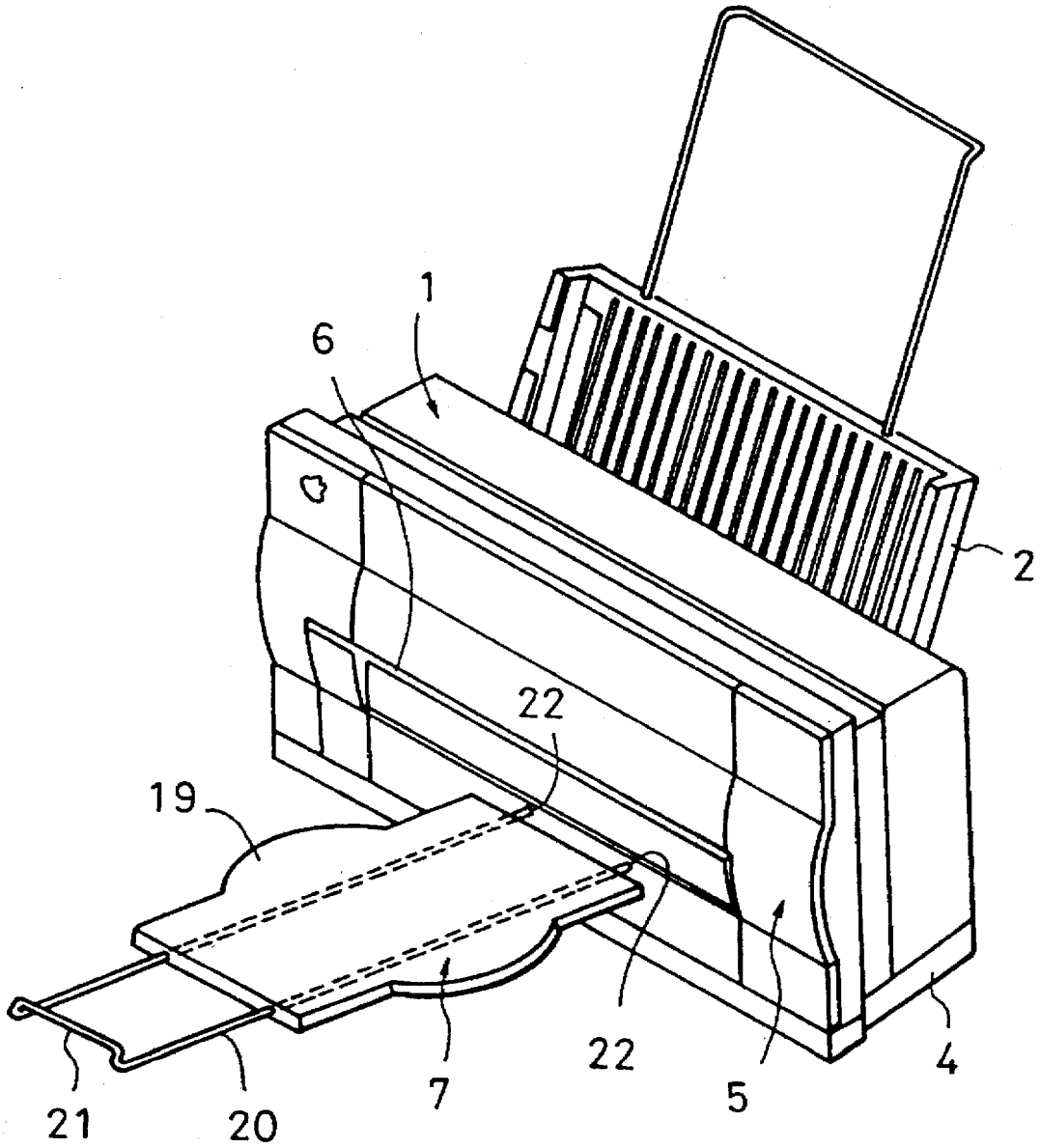
FIG. 7 is a schematic perspective view of a third embodiment of the recording apparatus in accordance with the present invention.

FIG. 7 is a schematic perspective view of a third embodiment of the recording apparatus of the invention having a paper ejection tray. The paper ejection tray 7 used in this embodiment has a tabular tray member 19 molded from plastics and a supporting wire member 20 which is bent in a substantially U-like form at its intermediate portion and embedded in and extended through the tabular tray member 19. When the recording apparatus is used, base ends 22 of the support wire member 20 are inserted into holes formed in the wall of the outer housing 1 of the recording apparatus. The U-bent end of the supporting wire member is bent upward as at 21 so as to prevent the stack of ejected sheets from slipping down over the end of the tray 7.

Referring to FIG. 7, when the recording apparatus is not used, the paper ejection tray 7 can be demounted from the apparatus simply by being pulling out of the apparatus. As in the case of the preceding embodiment described in connection with FIG. 5, the paper ejection tray 7 demounted from the body of the recording apparatus is stored in the storage means 14 provided in the recess of the bottom cover 4.

As will be understood from the foregoing description, according to the present invention, there is provided a recording apparatus comprising an outer housing and a paper ejection tray separable from the outer housing, wherein the outer housing is provided with a tray supporting means 12, 13, 20, 22 for demountably supporting the paper ejection tray 7 and a tray storage means 14 for storing the paper ejection tray 7. Consequently, the paper ejection tray 7 can have a simple and inexpensive construction and can easily be handled by the user.

Although an ink jet recording apparatus has been specifically mentioned in the foregoing description, it is to be understood that the invention can be applied to various other types of recording apparatuses or printers such as wire dot recording apparatuses, laser beam recording apparatuses, thermal transfer recording apparatuses and so forth, and produces the same advantages as those described above when applied to such recording apparatuses or printers. It is also to be noted that the invention can also be applied to line-printing type recording apparatuses in which a recording head has a length equal to the whole or part of the recording width of the recording member and offers the same advantages as those described above when applied to such line-printing type recording apparatuses or printers.

Furthermore, the invention can be carried out regardless of the number of the recording heads mounted on the recording apparatus. For instance, the invention can be carried in the form of a monochromatic recording apparatus which employs a single recording head, a multi-color recording apparatus which employs a plurality of recording heads for performing recording with inks of different colors, or a gradation recording apparatus which employs a plurality of recording heads which perform printing with inks of the same color but of different densities. The same advantages as those described above can be attained when the invention is applied to such a variety of types of recording apparatuses.

The invention also can be carried out regardless of the constructions of the recording means and the ink tank. For instance, the recording apparatus of the present invention may employ a cartridge type structure in which the recording head and the ink tank are constructed as a single unit so as to form a replaceable cartridge, or a separate type structure in which the recording head is connected to an ink tank through an ink supply tube. The advantages described above can be attained in either case, The present invention can suitably be applied to ink jet recording apparatuses such as, for example, to an ink jet recording apparatus of the type which employs an electromechanical converter incorporating, e.g., a piezoelectric element. The invention, however, can most suitably be applied to an ink jet recording apparatus of the type which jets an ink by force produced by thermal energy, because such type of ink jet apparatus offers a high density of recording, as well as a high degree of fineness of the image.

Such an ink jet recording apparatus using thermal energy is preferably constructed on the basis of the principle disclosed in U.S. Pats. Nos. 4,723,129 and 4,740,796. The ink jet recording apparatus using such principle may be either of the on-demand type or of the continuous type. In an on-demand type apparatus, an electromechanical transducer is disposed for each of the sheets or channels which hold ink, and at least one portion of a driving signal is selectively applied to each electrothermal transducer in accordance with the recording information so as to cause a rapid temperature rise to a level exceeding the nucleate boiling point. Thus, a film boiling is caused on the heating surface in each ink sheet or channel by the thermal energy generated by the electrothermal transducer, so that a bubble is generated in the ink in response to a single portion of the driving pulse signal.

The growth and contraction of the bubble causes at least one ink droplet to be discharged from the discharge opening. Preferably, the driving signal is applied in the form of a pulse so that growth and contraction of the ink are performed in good response to the driving signal. Preferably, pulse signals such as those disclosed in U.S. Pats. Nos. 4,463,359 and 4,345,262 are used as the driving signals. The quality of the recording can be further improved by employing conditions disclosed in U.S. Pat. No. 4,313,124, which pertains to the rate of temperature rise of the heating surface mentioned above.

The recording head of the recording apparatus of the present invention can have various combinations of discharge openings, straight or orthogonal liquid channels and electrothermal transducers, such as those shown in U.S. Pat. Nos. 4,558,333 and 4,459,600. The recording head also may be of the type which employs a common slit as the discharge portion for a plurality of electrothermal transducers as disclosed in Japanese Patent Laid-Open No. 59123670 or of the type in which an opening is formed in the discharge portion so as to absorb any pressure wave of thermal energy. Thus, according to the present invention, it is possible efficiently to conduct recording of information regardless of the type of the recording head.

Furthermore, the present invention can suitably be carried out in the form of a recording apparatus which employs a full-line type recording head having a length equal to the maximum width of the recording member, i.e.,the full length of the recording line. Such a full-line recording head may be composed of a plurality of recording head sections combined to cover the full length of the recording line or may be formed as a single integral recording head.

The recording apparatus of the present invention may be of a serial printing type as described before, or may employ a recording head which is fixed to the body of the recording apparatus. It is also possible to employ a replaceable chip type recording head which is adapted to be electrically connected to the body of the recording apparatus and to be connected to an ink source in the body of the recording apparatus when mounted on the recording apparatus, or a cartridge type recording apparatus which is provided with an ink tank integral therewith.

It is possible and preferred to provide the recording apparatus of the present invention with a recovery means for recovering good discharging condition of the recording head or other preparatory or auxiliary means which would ensure safe operation of the recording head and, hence, of the recording apparatus. Such recovery or auxiliary means may include, for example, capping means, cleaning means, pressurizing or suction means, preheating means having an electrothermal transducer or a separate heating element or a combination of such transducer and heating element, or a preparatory discharge means for performing preparatory discharge of the ink apart from the discharge conducted for the printing purpose.

There is no restriction on the type and number of the recording heads mounted in the recording apparatus of the present invention. For instance, the recording apparatus may employ a single recording head for monochromatic recording or may employ two or more recording heads which perform recording with inks of different density levels or colors. For instance, the recording apparatus of the present invention may be of the type which operates in at least one of a plurality of recording modes including a monochromatic recording mode which records information in a single main color such as black, a multi-color recording mode in which recording is conducted with different colors or a full-color recording mode which performs full-color recording by color mixing, regardless of whether the recording head is an integral type or is composed of a plurality of ink head units.

Inks have been specifically mentioned as the recording liquids in the preceding description. The ink may be of the type which is solid at temperatures below room temperature but is changed into liquid phase at temperatures above room temperature. In general, the temperature of the ink employed in ink jet recording is controlled to range between, for example, 30° C. and 70° C., so that the viscosity of the ink is maintained within a range which ensures stable discharge of the ink. Thus, any ink which is in liquid phase at least when supplied with the recording signal can be used as the recording liquid in the recording apparatus of the present invention. More specifically, it is possible to use an ink of the type in which thermal energy applied thereto is consumed for causing a change of the phase from solid to liquid so as to avoid a rise in the temperature of the ink, or an ink of the type which is in solid phase when not used so as to avoid loss of ink due to evaporation. Thus, the recording apparatus of the present invention may be of the type which employs an ink which is usually solid but is changed into liquid phase when supplied with thermal energy, such as an ink which is liquefied when thermal energy is applied thereto in accordance with the recording signal so as to be discharged in liquid phase, or an ink which starts to solidify when reaching the recording medium.

Such inks may be retained as a liquid or a solid in minute recesses or pores in a micro-porous sheet which is disposed to oppose an electrothermal transducer. In the present invention, however, the ink which exhibits film boiling mentioned before can be used most suitably.

It is also to be understood that the recording apparatus, in particular an ink jet recording apparatus, can be embodied in various forms such as a printer which is an image output terminal of an information processing apparatus such as a computer, a copying apparatus in which the recording apparatus is combined with a reader, or a facsimile apparatus which has transmission receiving function.

Figure 9:
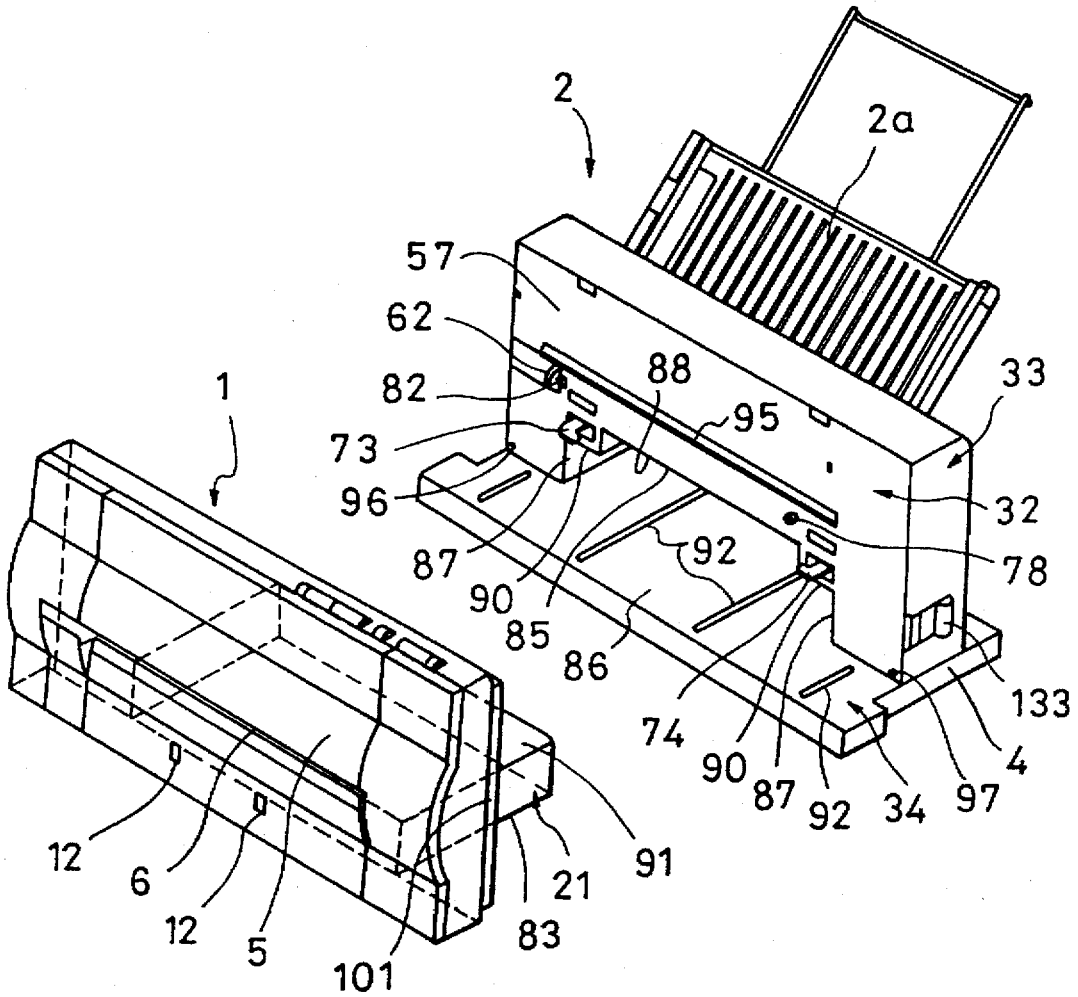
FIG. 9 is an illustration of another embodiment of the recording apparatus in accordance with the invention having a detachable automatic paper feeder.

A description will now be given of another embodiment, in which the automatic sheet feeder 2 is separable from the recording apparatus 1, with specific reference to FIG. 9. Referring to FIG. 9, the automatic sheet feeder 2 has a pair of hook members which have hooks 73 and 74 at their ends opposing the recording apparatus 1 for connection to the latter. The hook members are swingably mounted on the chassis 57 of the automatic feeder substantially in symmetry with each other, in such a manner as to be movable back and forth by a predetermined amount. The hook members are pulled by tension springs inwardly of the automatic sheet feeder so that the hooks 73 and 74 may be pressed against mating portions of the recording apparatus 1 when the automatic sheet feeder 2 is mounted thereon, The other ends of the hook members project to the exterior of the automatic sheet feeder 2 so as to receive a manual force to enable mounting and demounting of the automatic sheet feeder 2 on and from the recording apparatus 1.

The construction for combining the recording apparatus 1 and the automatic sheet feeder 2 is as follows. The hooks 73 and 74 on the hook members are inserted into angular holes formed in the outer housing of the recording apparatus and are made to engage with internal members inside the outer housing, The hook members are then pulled away from the recording apparatus 1 so that the hooks 73 and 74 are locked on the internal members, whereby the automatic sheet feeder 2 is coupled to the recording apparatus 1.

The automatic sheet feeder 2 is located correctly with respect to the recording apparatus 1, as a dowel pin on the chassis 57 of the automatic sheet feeder 2 is received in a mating hole formed in the recording apparatus 1 while a U-shaped projection 82 on the chassis 57 abutting a U-shaped groove in the recording apparatus 1. In the illustrated embodiment, auxiliary pins 96 and 97 are provided in lower left and right end portions respectively of the chassis 57. These auxiliary pins 96 and 97 are adapted to abut a lower case 101 of the recording apparatus so as to keep the opposing surfaces of the chassis 57 and the lower case 101 in parallel with each other. When the automatic sheet feeder 2 is correctly located with respect to the recording apparatus 1, the hooks 73 and 74 are received in angular holes formed in the lower case 101.

It is preferred that a rough guide means is provided to guide the automatic sheet feeder 2 roughly into alignment with the recording apparatus 1. Such a rough guiding function is performed by the following structure. The rear surface of the recording apparatus 1 facing the automatic sheet feeder 2 has a projection 21 which is composed of a bottom wall 83 integral with the lower wall of the lower case 101 and a cover placed on the bottom wall 83. Thus, the projection 21 has a generally rectangular parallelopipedal form as illustrated, with both side walls and top surfaces 91. The bottom wall 83 of the projection 21 carries a printed circuit board (not shown) which is covered by the above-mentioned top surface.

The automatic sheet feeder 2 has an opening 85 which guides and receives the projection 21. The opening 85 is defined by the upper surface 86 of the support base 34 of the automatic sheet feeder 2, and lower recessed surfaces of a sheet feeding drive unit 32 and a frame 33 and has a configuration conforming with the cross-sectional shape of the projection 21. Thus, the opening 85 has a guide surface presented by the upper surface 86 of the base 34, both side surfaces 87, a ceiling surface 88, and guide surfaces 90, which are located at both ends of the opening 85 and which guide the aforementioned top surfaces 91 of the projection 21.

The upper surface 86 of the base 34 serving as the guide surface is provided with a plurality of linear guide ribs or beads which extend in the direction of insertion, while linear grooves (not shown) for sliding engagement with these guide ribs 92 are formed in the bottom surface 83 of the projection 21. Rubber feet (not shown) may be provided on the lower surfaces of the lower case 101 and the projection 21 which provide the bottom surface of the recording apparatus.

What is claimed is:

1. A recording apparatus, comprising:

a housing;

recording means for recording on recording medium sheets;

feeding means for feeding recording medium sheets to said recording means;

a sheet ejection tray for receiving the recording medium sheets ejected from said recording means after recording by said recording means, said sheet ejection tray having opposing lateral ends; and sheet ejection tray supporting means, for detachably supporting said sheet ejection tray to receive the recording medium sheets, provided on said housing of said recording apparatus, said housing having at a bottom thereof a plurality of connected walls forming therein a sheet ejection tray storage recess underneath said recording apparatus, the sheet ejection tray storage recess capable of storing said sheet ejection tray when said sheet ejection tray has been detached from said sheet ejection tray supporting means when said sheet ejection tray is not being used to receive the ejected recording medium sheets, the depth of the sheet ejection tray storage recess being greater than the thickness of said sheet ejection tray, and the sheet ejection tray storage recess underneath said recording apparatus being open so that said sheet election tray can be stored therein and taken therefrom, wherein an inner surface of a first wall of said plurality of walls has projections formed thereon, and an inner surface of a second wall opposing said first wall has snapping projections formed thereon, said projections and snapping projections for detachably engaging the opposing lateral ends of said sheet ejection tray when said sheet ejection tray is stored in the sheet ejection tray storage recess, and wherein said sheet ejection tray has a cut-out portion at a side of one of the lateral ends of said sheet ejection tray which is detachably engaged by said projections.

2. A recording apparatus according to claim 1, further comprising auxiliary supporting means for further supporting said sheet ejection tray, including a member hinged to said sheet ejection tray.

3. A recording apparatus according to claim 1, wherein said sheet ejection tray includes a tabular tray member and supporting wire means, embedded in said tray member and extending through said tray member, for engagement with said sheet ejection tray supporting means, to support said sheet ejection tray.

4. A recording apparatus according to claim 1, wherein said recording means includes means defining discharge openings for discharging ink, an ink chamber for storing ink to be supplied to said discharge openings, ink channels providing communication between said discharge openings and said ink chamber, and discharge energy generating elements disposed in said ink channels for generating energy by which the ink is discharged through said discharge openings.

5. A recording apparatus according to claim 4, wherein said discharge energy generating elements comprise electrothermal transducers which generate heat energy to cause the ink to be discharged through said discharge openings.

6. A recording apparatus according to claim 1, wherein each of said snapping projections comprises a L-shaped hook and a tapered surface over which said sheet ejection tray slips, and each of said projections comprises a round hook.

7. A recording apparatus according to claim 1, wherein said sheet ejection tray has opposing non-lateral ends, one non-lateral end capable of being supported by said sheet ejection tray supporting means and the other non-lateral end having said cut-out portion.

8. A recording apparatus according to claim 1, wherein said cut-out portion is a notch.

* * * * *

UNITED STATES PATENT AND TRADEMARK OFFICE

CERTIFICATE OF CORRECTION

PATENT NO. : 5,680,166

DATED : October 21, 1997

INVENTOR(S) : NOZOMU NISHIBERI

It is certified that error appears in the above-identified patent and that said Letters Patent is hereby corrected as shown below:

TITLE PAGE AT [75]
Inventor, "Kawasakishi" should read --Kawasaki--.

TITLE PAGE AT [57] ABSTRACT
Line 6, "head," should read --head.--.

Line 10, "detachabldy" should read --detachably--.

COLUMN 1
Line 50, "Among" should read --¶ Among--.

COLUMN 2
Line 12, "trap" should read --trays--.

Figure 1:
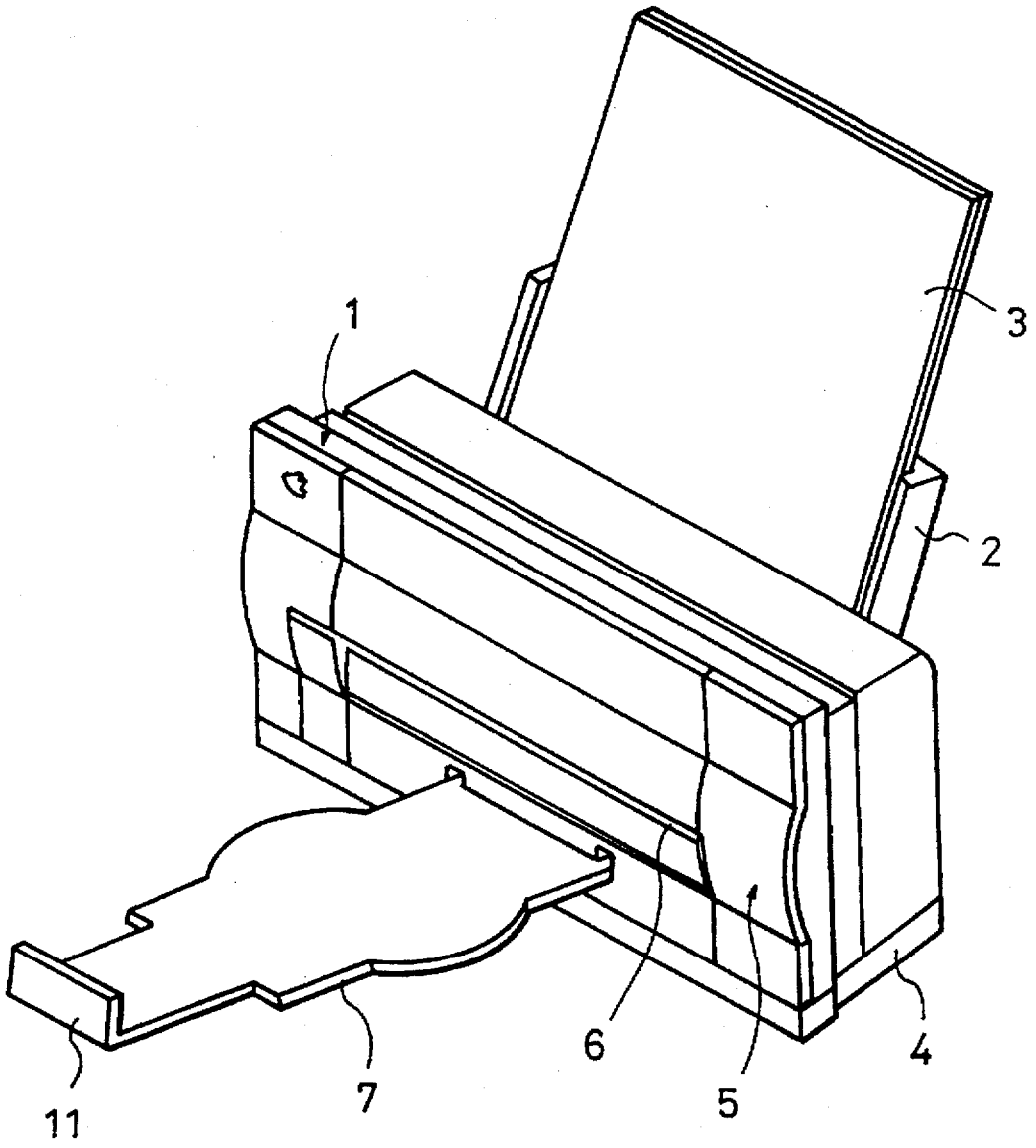
FIG. 1 is a schematic perspective view of an embodiment of the recording apparatus in accordance with the present invention.

COLUMN 3
Line 30, "FIG.," should read --FIG. 1,--;
Line 45, "56" should read --5b--;
Line 46, "scan," should read --scan.--.

COLUMN 4
Line 24, "5," should read --5.--.

COLUMN 5
Line 26, "14," should read --14.--
Line 29, "1," should read --1.--
Line 34, "17," should read --17.--

UNITED STATES PATENT AND TRADEMARK OFFICE

CERTIFICATE OF CORRECTION

PATENT NO. : 5,680,166

DATED : October 21, 1997

INVENTOR(S) : NOZOMU NISHIBERI

It is certified that error appears in the above-identified patent and that said Letters Patent is hereby corrected as shown below:

COLUMN 6

Line 30, "pulling" should read --pulled--.

COLUMN 9

Line 11, "transmission receiving" should read --transmission/receiving--;

Line 25, "thereon," should read --thereon.--

COLUMN 10

Line 49, "election" should read --ejection--.

Signed and Sealed this

Twelfth Day of May, 1998

Bruce Lehman

*Attest:*

BRUCE LEHMAN

*Attesting Officer*

*Commissioner of Patents and Trademarks*